US010801773B2

(12) United States Patent
Shannigrahi

(10) Patent No.: US 10,801,773 B2
(45) Date of Patent: Oct. 13, 2020

(54) METALLIC TRIM BREAKER FOR A REFRIGERATING APPLIANCE HAVING A THERMAL BRIDGE GEOMETRY

(71) Applicant: WHIRLPOOL CORPORATION, Benton Harbor, MI (US)

(72) Inventor: Subrata Shannigrahi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/236,386

(22) Filed: Dec. 29, 2018

(65) Prior Publication Data

US 2020/0208903 A1 Jul. 2, 2020

(51) Int. Cl.
*F25D 23/08* (2006.01)
*F25D 23/06* (2006.01)

(52) U.S. Cl.
CPC ..... *F25D 23/085* (2013.01); *F25D 23/065* (2013.01); *F25D 2323/06* (2013.01)

(58) Field of Classification Search
CPC ..... F25D 23/06; F25D 23/061; F25D 23/062; F25D 23/065; F25D 23/067; F25D 23/085; F25D 2323/06
See application file for complete search history.

(56) References Cited

U.S. PATENT DOCUMENTS 2,185,228 A * 1/1940 Schweller ..... F25D 11/02 62/295
2,190,954 A * 2/1940 Stickel ..... F25D 23/082 220/592.06
2,371,987 A * 3/1945 Goulooze ..... F25D 23/082 220/592.08
2,599,733 A * 6/1952 Whitmore ..... F25D 23/062 62/451
2,729,863 A 1/1956 Kurtz
5,297,360 A * 3/1994 Besore ..... F25D 23/087 49/478.1
5,586,680 A 12/1996 Dellby et al.
6,217,140 B1 * 4/2001 Hirath ..... F25D 23/062 312/406
6,224,179 B1 * 5/2001 Wenning ..... F24C 15/34 312/406
6,485,122 B2 11/2002 Wolf et al.
6,655,766 B2 * 12/2003 Hodges ..... F25D 23/085 312/406.2
7,204,568 B2 * 4/2007 Lim ..... F25D 23/087 277/645
9,170,046 B2 10/2015 Jung et al.
(Continued)

FOREIGN PATENT DOCUMENTS

EP 0658716 A1 * 6/1995 ..... F16L 59/065
EP 0672876 A1 * 9/1995 ..... F25D 23/04
(Continued)

*Primary Examiner* — Andrew M Roersma
(74) *Attorney, Agent, or Firm* — Price Heneveld LLP

(57) ABSTRACT

A structural cabinet for an appliance includes an inner liner that defines an interior compartment, an outer wrapper and a metallic trim breaker that is attached to each of the inner liner and the outer wrapper. The metallic trim breaker includes a plurality of undulating formations that extend an effective length of the trim breaker between the inner liner and the outer wrapper.

20 Claims, 6 Drawing Sheets

(56) References Cited

U.S. PATENT DOCUMENTS

| | | | | |
|---|---|---|---|---|
| 9,228,775 | B2 | 1/2016 | Jung et al. | |
| 9,389,013 | B2 | 7/2016 | Rolek et al. | |
| 2016/0258671 | A1* | 9/2016 | Allard | F25D 23/065 |
| 2017/0157890 | A1* | 6/2017 | Deka | B32B 5/16 |
| 2017/0160001 | A1* | 6/2017 | Deka | F25D 23/062 |
| 2017/0292776 | A1 | 10/2017 | Kim et al. | |
| 2018/0231298 | A1 | 8/2018 | Jung et al. | |

FOREIGN PATENT DOCUMENTS

| | | | | |
|---|---|---|---|---|
| GB | 725546 A * | 3/1955 | | F25D 23/028 |
| WO | WO-0116540 A1 * | 3/2001 | | F25D 23/065 |

* cited by examiner

METALLIC TRIM BREAKER FOR A REFRIGERATING APPLIANCE HAVING A THERMAL BRIDGE GEOMETRY

FIELD OF THE DEVICE

The device is in the field of refrigerating appliances, and more specifically, a trim breaker for a refrigerating appliance that incorporates a thermal bridge design using a plurality of undulations for extending the thermal path through the trim breaker.

SUMMARY

In at least one aspect, a structural cabinet for an appliance includes an inner liner that defines an interior compartment, an outer wrapper and a metallic trim breaker that is attached to each of the inner liner and the outer wrapper. The metallic trim breaker includes a plurality of undulating formations that extend an effective length of the trim breaker between the inner liner and the outer wrapper.

In at least another aspect, a structural cabinet for an appliance includes a metallic inner liner, a metallic outer wrapper and a metallic trim breaker that is welded to the metallic inner liner and the metallic outer wrapper to define an interior insulating cavity therebetween. The metallic trim breaker includes a plurality of undulating formations that extend an effective length of the trim breaker between the inner liner and the outer wrapper. Insulating spacers are positioned between adjacent undulations of the plurality of undulations for the metallic trim breaker.

In at least another aspect, an appliance includes a structural cabinet that includes a metallic inner liner and a metallic outer wrapper. A metallic trim breaker is welded to the metallic inner liner and the metallic outer wrapper to define an interior insulating cavity within the structural cabinet. The metallic trim breaker includes undulating formations that define an effective length of the trim breaker between the inner liner and the outer wrapper. The effective length of the trim breaker is greater than a perpendicular distance separating the metallic inner liner form the metallic outer wrapper. Insulating spacers are positioned between adjacent corrugations of the undulating formations for the metallic trim breaker. A cap member that extends between the inner liner and the outer wrapper. The cap member conceals the undulating formations of the metallic trim breaker.

These and other features, advantages, and objects of the present device will be further understood and appreciated by those skilled in the art upon studying the following specification, claims, and appended drawings.

DETAILED DESCRIPTION OF EMBODIMENTS

Figure 1:
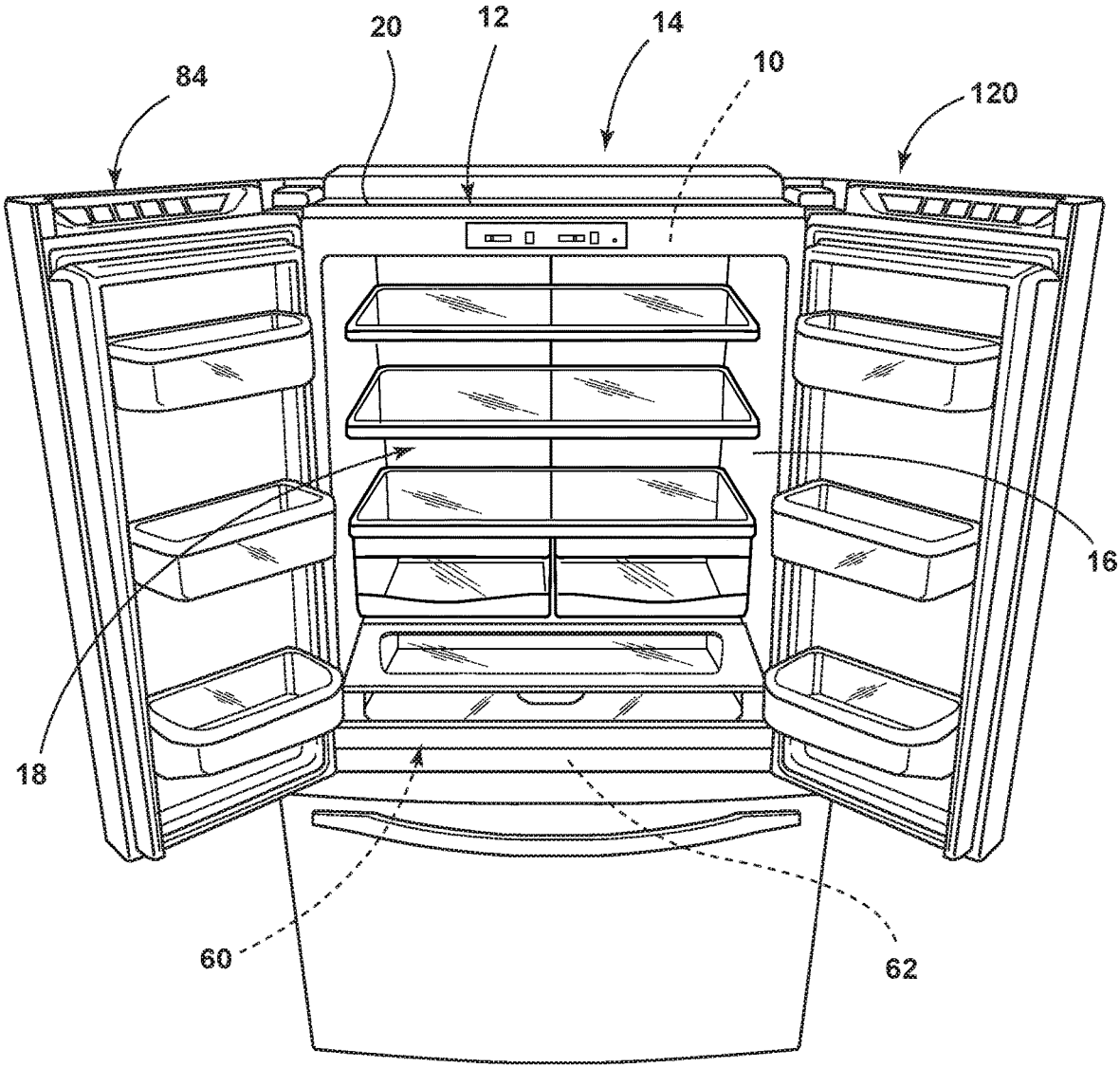
FIG. 1 is a front perspective view of a refrigerating appliance that incorporates an aspect of the metallic trim breaker having the thermal bridge design.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
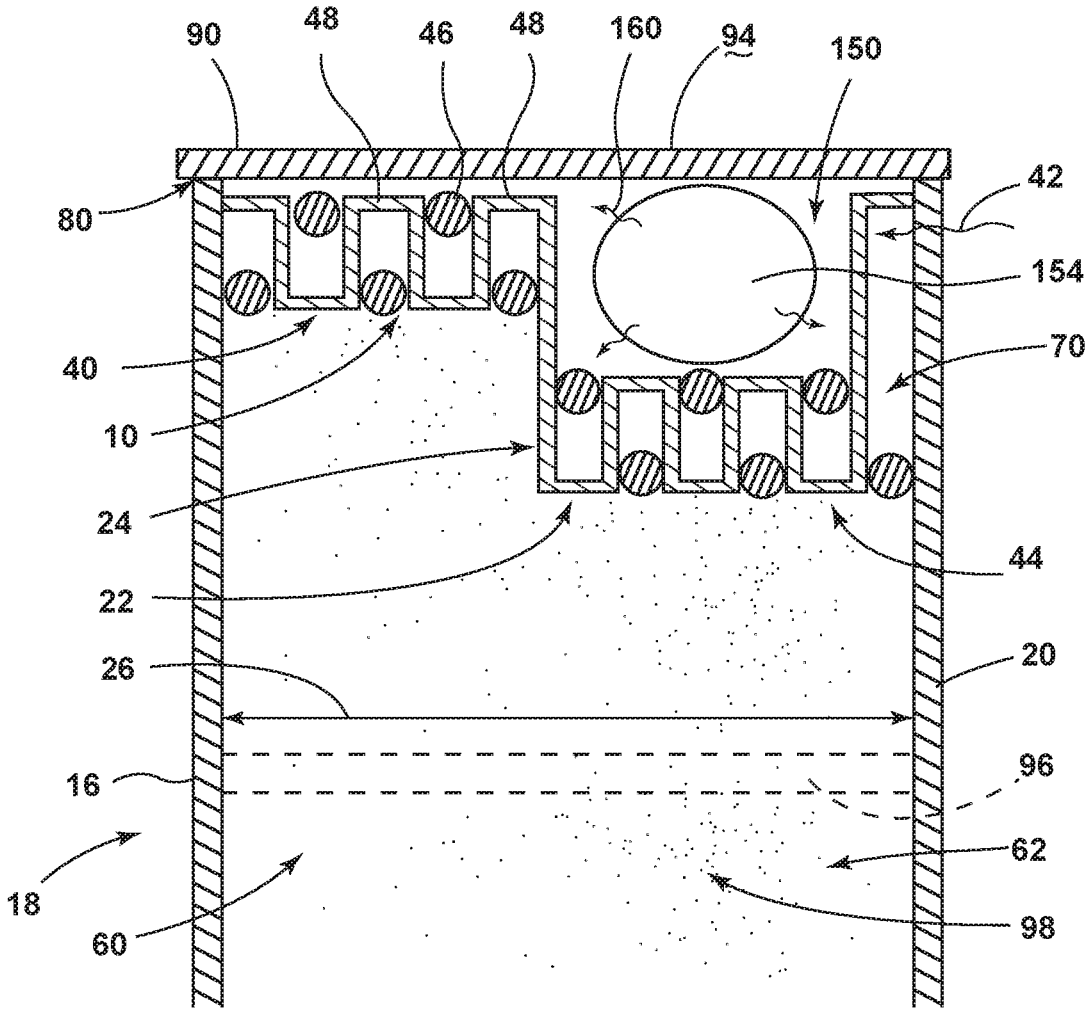
FIG. 2 is a cross-sectional view of the refrigerating appliance of FIG. 1 taken along II-II.

With respect to FIGS. 1 and 2, reference numeral 10 generally refers to a trim breaker that can be incorporated with a structural cabinet 12 for an appliance 14. According to various aspects of the device, the structural cabinet 12 for the appliance 14 can include an inner liner 16 that defines an interior compartment 18 and an outer wrapper 20. The trim breaker 10, typically a metallic trim breaker, is attached to each of the inner liner 16 and the outer wrapper 20. The trim breaker 10 includes a plurality of undulating formations 22 that define an effective length 24 of the trim breaker 10 between the inner liner 16 and the outer wrapper 20. This effective length 24 of the trim breaker 10 is greater than or longer than a perpendicular distance 26 that separates the inner liner 16 from the outer wrapper 20. Typically, the inner liner 16 is a metallic inner liner 16 and the outer wrapper 20 is a metallic outer wrapper 20.

Referring again to FIGS. 1 and 2, the trim breaker 10 includes the plurality of undulating formations 22 that are positioned to extend sinusoidally between the inner liner 16 and the outer wrapper 20. This sinusoidal configuration of the trim breaker 10 defines the thermal bridge 40 that extends between the inner liner 16 and the outer wrapper 20. During operation of the appliance, the interior compartment 18 for the structural cabinet 12 is cooled to a refrigerating or freezing temperature. Heat 42 from areas surrounding the appliance 14 tend to infiltrate into the interior compartment 18 in order to equalize the temperature. The trim breaker 10 that extends between the inner liner 16 and the outer wrapper 20 is typically a convenient path through which heat 42 can transfer from the outer wrapper 20 and to the inner liner 16. Using the thermal bridge design that is formed by the plurality of undulating formations 22 of the trim breaker 10, the effective length 24 of the trim breaker 10 is extended so that transfer of heat 42 through the trim breaker 10 occurs much slower. By slowing the transfer of heat 42 through the trim breaker 10, the effect of this thermal transfer via the trim breaker 10 can be lessened.

This configuration serves to make the refrigerating system for the appliance 14 more efficient, thereby using less resources. The undulating formations 22 that are defined by the thermal bridge design of the trim breaker 10 can vary in the amplitude and frequency of the individual corrugations 44 or undulations. In order to maintain the undulations separated from one another, insulating spacers 46 are positioned between adjacent undulations 48 of the plurality of undulating formations 22. Where adjacent undulations 48 come into direct contact with one another or close contact with one another, heat 42 traveling through the trim breaker 10 may tend to "jump" or bypass certain corrugations 44 to find the most efficient path through the trim breaker 10. By including the insulating spacers 46 between adjacent undulations 48, the adjacent undulations 48 are maintained separated from one another. Additionally, the use of the insulating spacers 46 serves to prevent thermal transfer at the ends of each of the adjacent undulations 48. The insulating spacers 46 are configured to be resistant to thermal transfer therethrough. Using the plurality of undulating formations 22 and the insulating spacers 46 that are positioned therebetween, transfer of heat 42 through the trim breaker 10 is configured to occur through the entire effective length 24 of the trim breaker 10, thereby extending the length of the time that it may take for the heat 42 to transfer through the trim breaker 10 and into the interior compartment 18 defined by the inner liner 16.

Referring now to FIGS. 2-5, the inner liner 16 and the outer wrapper 20 are typically metallic members that are welded to the metallic trim breaker 10. The use of welding between the trim breaker 10 and the inner liner 16 and the outer wrapper 20 serves to define a substantially airtight seal between the trim breaker 10 and the remainder of the structural cabinet 12. Accordingly, expression of gas from within an insulating cavity 62 defined between the trim breaker 10, the inner liner 16 and the outer wrapper 20 results in a partial vacuum 60 within the insulating cavity 62 that can be maintained for a significant period of time. Additionally, the plurality of undulating formations 22 can be formed in varying orientations within the structural cabinet 12.

Figure 3:
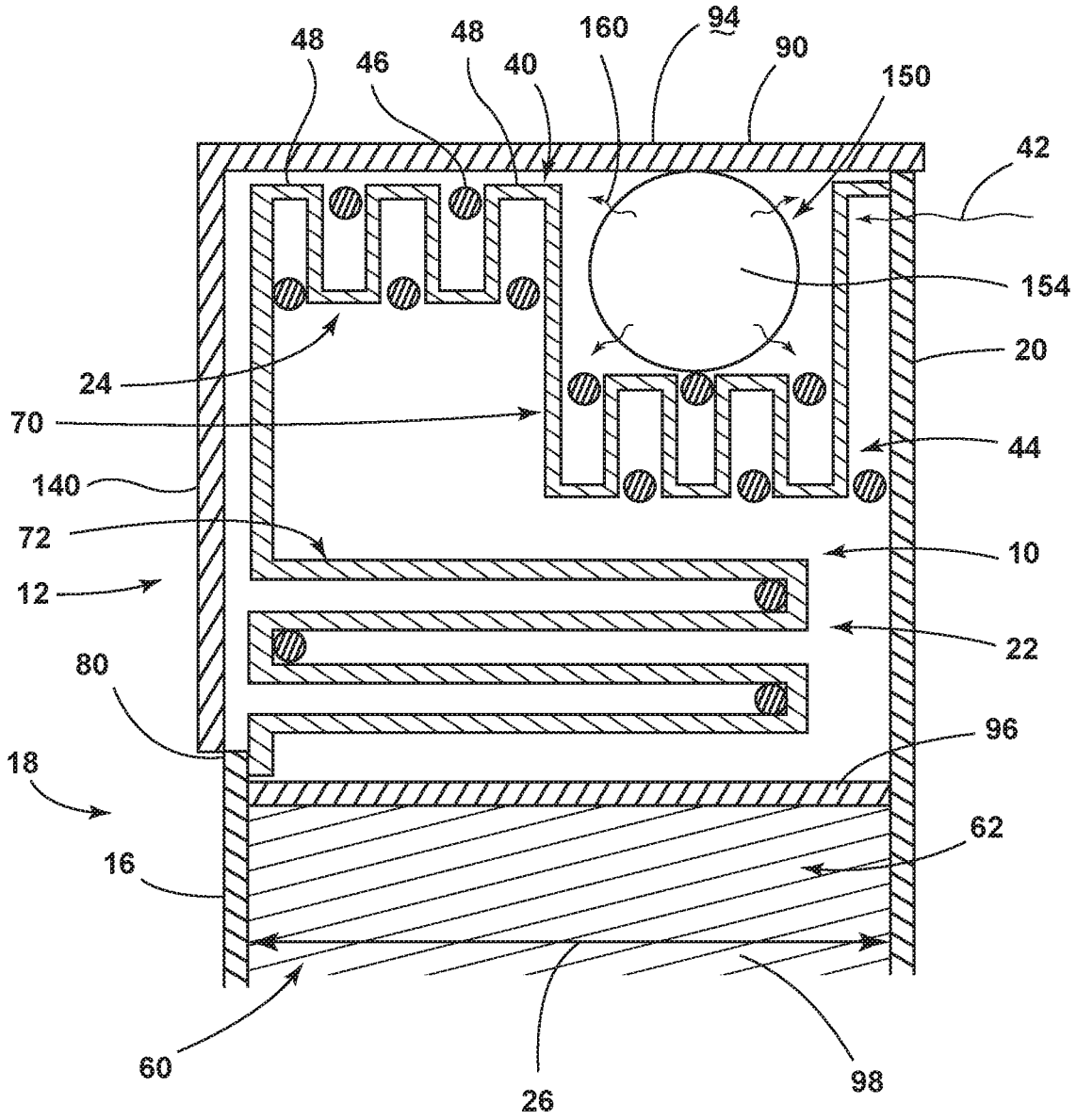
FIG. 3 is an alternative aspect of a cross-sectional view of a trim breaker for a refrigerating appliance.
Figure 4:
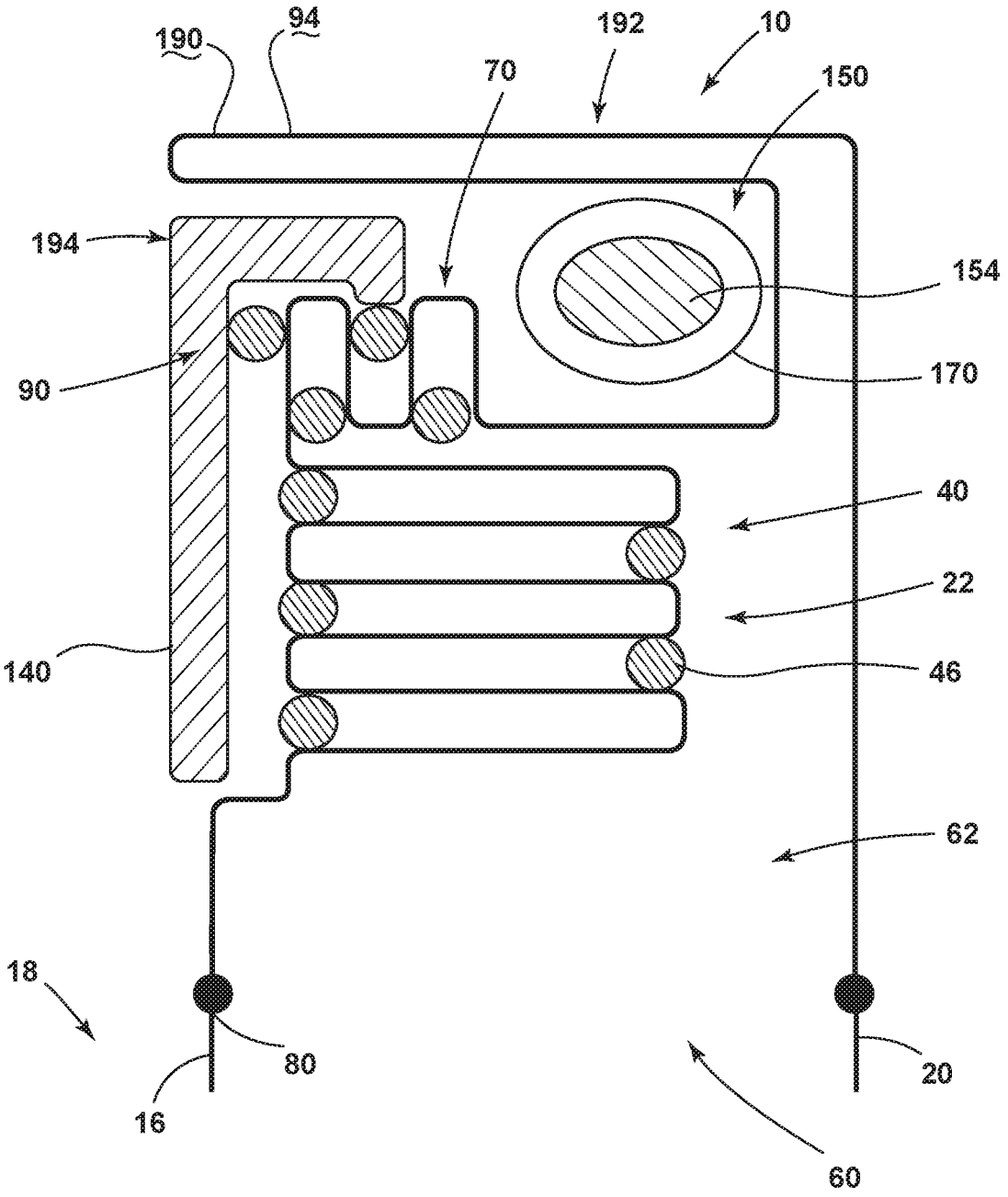
FIG. 4 is an alternative aspect of a cross-sectional view of a trim breaker for a refrigerating appliance.
Figure 5:
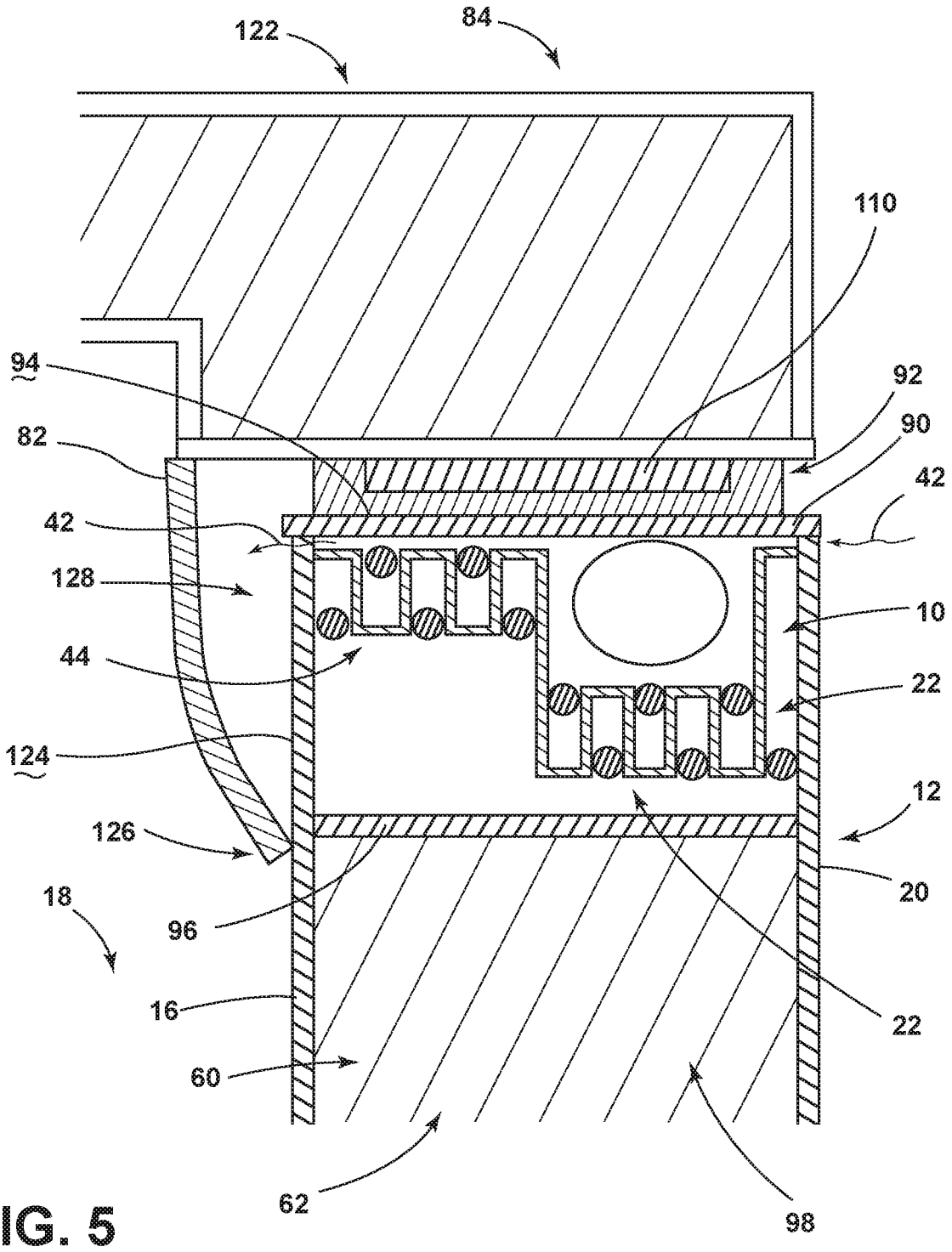
FIG. 5 is a cross-sectional view of the trim breaker of FIG. 2 and showing cooperation of the trim breaker with an operable door panel in a closed position.

As exemplified in FIGS. 3 and 4, the plurality of undulating formations 22 can undulate in an orientation that is generally parallel with the inner liner 16 and the outer wrapper 20. Additionally, the metallic trim breaker 10 can extend rearward of these parallel undulations 70 so that additional perpendicular undulations 72 can be formed behind the parallel undulations 70. The combination of these parallel and perpendicular undulations 70, 72 forms an increased effective length 24 of the trim breaker 10 between the inner liner 16 and the outer wrapper 20. Where the parallel and perpendicular undulations 70, 72 are utilized within the trim breaker 10, it is typical that the inner liner 16 may be offset in a direction rearward of a contact surface 94 for the structural cabinet 12. By offsetting the edge 80 of the inner liner 16, additional corrugations 44 can be formed within the metallic trim breaker 10 to increase the effective length 24 of the trim breaker 10. The use of the offset configuration for the inner liner 16 is typically used in conjunction with a thermal dyke 82 for an operable door panel 84. This configuration of the thermal dyke 82 used in conjunction with the metallic trim breaker 10 will be described more fully below.

Referring again to FIGS. 1-5, the structural cabinet 12 can include a cap member 90 that extends over the metallic trim breaker 10. The use of the cap member 90 serves to conceal the plurality of undulating formations 22 for the metallic trim breaker 10 from view. Additionally, the cap member 90 protects the plurality of undulating formations 22 from deflection or other damage during use of the appliance 14. Typically, the cap member 90 is a plastic cover that extends between the inner liner 16 and the outer wrapper 20. Where the cap member 90 is placed at an outer edge 80 of the structural cabinet 12, the cap member 90 can receive a magnetic seal 92 of the operable door panel 84. In this configuration, the cap member 90 can define a contact surface 94 that is adapted to receive the magnetic seal 92 for the operable door panel 84 and provide a sealing engagement between the operable door panel 84 and the structural cabinet 12. To further protect the plurality of undulations, an inner cap 96 can also be disposed within the insulating cavity 62 to at least partially separate the trim breaker 10 from an insulating material 98.

Referring again to FIGS. 2-5, in certain aspects of the device, the metallic trim breaker 10 can be made of a ferromagnetic material. Using this ferromagnetic material, the metallic trim breaker 10 can serve to provide an electromagnetic communication with the magnet 110 contained within the magnetic seal 92 for the operable door panel 84. In this manner, additional magnets or ferromagnetic materials may not be included within the structural cabinet 12 for engaging the magnetic seal 92 of the operable door panel 84. It is also contemplated that the metallic trim breaker 10 may be made of a material that is not ferromagnetic. In such an embodiment, an additional ferromagnetic member or magnet can be installed near the cap member 90 for providing the electromagnetic communication for magnetically coupling the magnetic seal 92 with the structural cabinet 12 for the appliance 14.

Referring again to FIGS. 1-5, the operable door panel 84 for the appliance 14 can operate between open and closed positions 120, 122. The operable door panel 84 typically includes the thermal dyke 82 that engages an interior surface 124 of the interior compartment 18 of when an operable door panel 84 in the closed position 122. This interior surface 124 can be defined by the inner liner 16. The interior surface 124 can also be defined by the portion of the cap member 90 where the inner liner 16 is offset in a rearward direction from the contact surface 94 for the structural cabinet 12. According to various aspects of the device, the thermal dyke 82 is configured to engage the interior compartment 18 at an inward position 126 of a plurality of undulations for the metallic trim breaker 10. Through this configuration, the plurality of undulations that are located near the inner liner 16 or the interior surface 124 of the structural cabinet 12 are substantially surrounded by the thermal dyke 82. As discussed above, the thermal dyke 82 extends from the operable door panel 84 to the position inward of the contact surface 94 and the plurality of undulating formations 22. Accordingly, the thermal dyke 82 forms an insulating air space 128 that is contained between the thermal dyke 82 and the interior surface 124 of the structural cabinet 12. The plurality of undulating formations 22 are located near this insulating air space 128. Accordingly, any thermal transfer that may occur through the plurality of undulating formations 22 and from the outer wrapper 20 to the inner liner 16 will result in this heat 42 being transferred into the insulating air space 128 surrounded by the thermal dyke 82. Accordingly, the thermal dyke 82 that forms the insulating air space 128 provides an additional thermal barrier for preventing infiltration of heat 42 from the outer wrapper 20, to the inner liner 16, and into the interior compartment 18 for the appliance 14.

Referring again to FIGS. 3-5, as discussed above, certain embodiments of the device can include the inner liner 16 that is offset in a rearward direction and to an inward position 126 from the contact surface 94. In such an embodiment, an inward extension 140 of the cap member 90 can wrap from the contact surface 94 and turn to extend generally parallel with portions of the inner liner 16 near the contact surface 94. Typically, the inward extension 140 of the cap member 90 is utilized where the plurality of undulations for the metallic trim breaker 10 include the parallel undulations 70 and the perpendicular undulations 72. The inward extension 140 of the cap member 90 can protect any perpendicular undulations 72 that extend perpendicularly between the inner liner 16 and the outer wrapper 20.

Referring again to FIGS. 2-5, in various aspects of the device, the plurality of undulating formations 22 and the cap member 90 can cooperatively define an interstitial space 150 that extends along the contact surface 94 for the structural cabinet 12. This interstitial space 150 can be used to house various utility features for the appliance 14. These utility features can include a utility conduit 170 that extends through this interstitial space 150. The utility conduit 170 can contain a heat loop 154 that serves to transfer heat 42 from the heat loop 154 and to the contact surface 94 for the structural cabinet 12. In this manner, the heat loop 154 serves to prevent condensation from forming on the contact surface 94.

Typically, the heat loop 154 is positioned near the outer wrapper 20 and is surrounded by a portion of the undulations that are located near the outer wrapper 20. In this configuration, heat 42 emanating from the heat loop 154 is transferred through the contact surface 94. Residual heat 160 from the heat loop 154 may transfer rearward and into a portion of the metallic trim breaker 10. The plurality of undulating formations 22 of the metallic trim breaker 10 prevent thermal transfer of this heat 42 from the heat loop 154 from conveniently transferring through the remainder of the undulations and into the inner liner 16. Accordingly, the plurality of undulating formations 22 prevent transfer of heat 42 from the heat loop 154 through the metallic trim breaker 10 and into the interior compartment 18 for the appliance 14. In this manner, substantially all of the heat 42 from the heat loop 154 is directed to the contact surface 94 for heating this contact surface 94 for preventing condensation from forming thereon.

Figure 6:
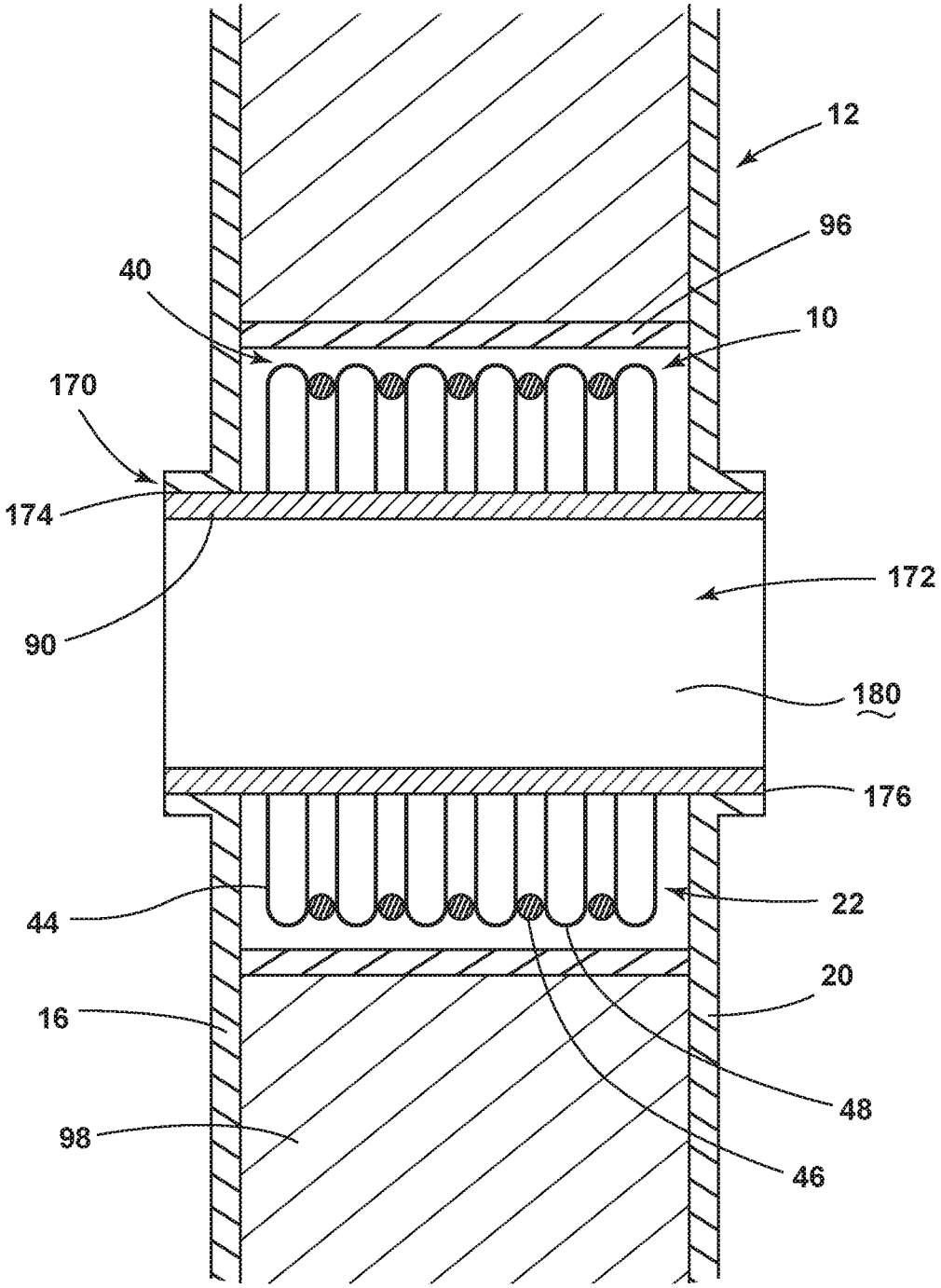
FIG. 6 is a cross-sectional view of a utility conduit that incorporates an aspect of the trim breaker having a thermal bridge design.

Referring now to FIGS. 1 and 6, the metallic trim breaker 10 can extend between the inner liner 16 and the outer wrapper 20 to form a utility conduit 170 that extends through the structural cabinet 12. Accordingly, the metallic trim breaker 10 can define a pass through 172 that extends between a liner aperture 174 formed within the inner liner 16 and a wrapper aperture 176 formed within the outer wrapper 20. The plurality of undulating formations 22 radiate outward from this utility conduit 170 to extend the effective length 24 of the trim breaker 10 between the inner liner 16 and the outer wrapper 20. The cap member 90 in this configuration serves to define the inside surface 180 of the pass through 172 through which various services can extend, such as from a machine compartment of the appliance 14 and into portions of the structural cabinet 12 proximate the interior compartment 18. As discussed previously, the plurality of undulating formations 22 for the trim breaker 10 are separated by the insulating spacers 46 that are positioned between adjacent undulations 48 of the plurality of undulating formations 22.

Referring again to FIGS. 1-6, the structural cabinet 12 includes the metallic inner liner 16 and the metallic outer wrapper 20. The metallic trim breaker 10 is welded to the metallic inner liner 16 and the metallic outer wrapper 20 to define interior insulating cavity 62 within the structural cabinet 12. The metallic trim breaker 10 includes undulating formations 22, such as the plurality of corrugations 44, that define an effective length 24 of the trim breaker 10 between the inner liner 16 and the outer wrapper 20. As discussed above, this effective length 24 is greater than a perpendicular distance 26 that separates the metallic inner liner 16 from the metallic outer wrapper 20. Insulating spacers 46 are positioned between the adjacent undulations 48 of the plurality of corrugations 44 for the metallic trim breaker 10. The cap member 90 extends between the inner liner 16 and the outer wrapper 20. The cap member 90 serves to seal and protect the plurality of undulating formations 22 and the individual corrugations 44 of the metallic trim breaker 10. As discussed above, the metallic trim breaker 10 can define a utility conduit 170 that extends between a liner aperture 174 in the metallic inner liner 16 and a wrapper aperture 176 in the metallic outer wrapper 20. Accordingly, the metallic trim breaker 10, in cooperation with the cap member 90, serves to provide a utility conduit 170 that extends through the interior insulating cavity 62 for the structural cabinet 12. The metallic trim breaker 10 can also define an outer surface 190 of the structural cabinet 12 that cooperates with the cap member 90 to define a contact surface 94. As discussed above, the contact surface 94 is configured to selectively receive a magnetic seal 92 of the operable door panel 84. This magnetic seal 92 engages the contact surface 94 to define a closed position 122 for the operable door panel 84.

Referring now to FIG. 4, in various aspects of the device, the metallic trim breaker 10 can define a separate member that is welded to the inner liner 16 and the outer wrapper 20. This separate member can define an extension of the inner liner 16 and the outer wrapper 20 that extends forward of these portions to define the outer surface 190 of the structural cabinet 12 and the contact surface 94. In such an embodiment, the metallic trim breaker 10 may define the contact surface 94 for the structural cabinet 12. This contact surface 94 may be defined by one of the perpendicular undulations 72 of the metallic trim breaker 10 at the outer portion 192 of the structural cabinet 12. It is contemplated that the cap member 90, in this embodiment, may be positioned parallel with the inner liner 16 to define the engaging surface 194 that cooperates with the thermal dyke 82 of the operable door panel 84 to form the insulating air space 128 that separates the interior compartment 18 from the plurality of undulations 22 of the thermal trim breaker 10.

According to various aspects of the device, the metallic trim breaker 10 having a plurality of undulating formations 22 to form the thermal bridge design can be used within various appliances 14. Such appliances 14 can include, but are not limited to, refrigerators, freezers, coolers, laundry appliances, ovens, dishwashers, small appliances, combinations thereof, and other similar residential and commercial appliances and fixtures.

Within the various aspects of the device, the terms sinusoidal and undulating formations 22 are used to describe the general shape of the trim breaker 10 extending between the inner liner 16 and the outer wrapper 20. It should be understood that the shape of the corrugations 44 within the sinusoidal shape of the undulating formations 22 can define multiple undulating shapes. These undulating shapes can take the form of smooth curves, angular formations, rectilinear undulations, polygonal formations, accordion-type structures, crumpled formations, irregular formations, combinations thereof and other similar shapes that can be used to extend the effective length of the trim breaker 10 between the inner liner 16 and the outer wrapper 20.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A structural cabinet for an appliance, the structural cabinet comprising:

an inner liner that defines an interior compartment;

an outer wrapper; and a metallic trim breaker that is attached to each of the inner liner and the outer wrapper, the metallic trim breaker including a plurality of undulating formations that extend an effective length of the metallic trim breaker between the inner liner and the outer wrapper, the metallic trim breaker including insulating spacers that are positioned between adjacent undulations of the plurality of undulating formations at each side of the metallic trim breaker, wherein the plurality of undulating formations are maintained separate from one another by the insulating spacers, and wherein the insulating spacers are positioned at ends of the adjacent undulations to further define open spaces between the adjacent undulations of the plurality of undulating formations.

2. The structural cabinet of claim 1, wherein the inner liner and the outer wrapper are each metallic and the metallic trim breaker is welded to the inner liner and the outer wrapper.

3. The structural cabinet of claim 1, wherein the plurality of undulating formations are positioned to extend sinusoidally between the inner liner and the outer wrapper.

4. The structural cabinet of claim 1, further comprising:

a cap member that extends between the inner liner and the outer wrapper, wherein the cap member conceals the plurality of undulating formations of the metallic trim breaker.

5. The structural cabinet of claim 4, wherein the cap member defines a contact surface for selectively receiving a magnetic seal of an operable door panel.

6. The structural cabinet of claim 5, wherein the plurality of undulating formations and the cap member define an interstitial space, wherein a heat loop is disposed within the interstitial space and the heat loop is in thermal communication with the contact surface of the cap member.

7. The structural cabinet of claim 5, wherein the metallic trim breaker is a ferromagnetic member that is configured to define an electromagnetic communication with the magnetic seal of the operable door panel.

8. The structural cabinet of claim 4, further comprising:

an operable door panel that is operable between open and closed positions, wherein the operable door panel includes a thermal dyke that engages an interior surface of the interior compartment when the operable door panel is in the closed position.

9. The structural cabinet of claim 8, wherein the thermal dyke engages the interior surface of the interior compartment at a position inward of the plurality of undulating formations, wherein the plurality of undulating formations proximate the inner liner are substantially surrounded by an insulating air space defined between the thermal dyke and the interior surface of the interior compartment.

10. The structural cabinet of claim 8, wherein the interior surface of the interior compartment proximate the metallic trim breaker is at least partially defined by an inward extension of the cap member.

11. The structural cabinet of claim 1, wherein the metallic trim breaker defines a utility conduit that extends between a liner aperture in the inner liner and a wrapper aperture in the outer wrapper.

12. The structural cabinet of claim 1, further comprising:

an insulating material disposed within an insulating cavity defined between the inner liner and the outer wrapper; and an inner cap positioned within the insulating cavity that separates the insulating material from the plurality of undulating formations of the metallic trim breaker.

13. A structural cabinet for an appliance, the structural cabinet comprising:

a metallic inner liner;

a metallic outer wrapper;

a metallic trim breaker that is welded to the metallic inner liner and the metallic outer wrapper to define an interior insulating cavity therebetween, wherein the metallic trim breaker includes a plurality of undulating formations that extend an effective length of the metallic trim breaker between the metallic inner liner and the metallic outer wrapper;

insulating spacers that are positioned at each side of the metallic trim breaker and between adjacent undulations of the plurality of undulating formations of the metallic trim breaker, wherein the insulating spacers further define open spaces between each of the undulating formations;

an insulating material disposed within the interior insulating cavity; and an inner cap positioned within the interior insulating cavity that separates the insulating material from the plurality of undulating formations of the metallic trim breaker.

14. The structural cabinet of claim 13, further comprising:

a cap member that extends between the metallic inner liner and the metallic outer wrapper, wherein the cap member conceals the plurality of undulating formations of the metallic trim breaker.

15. The structural cabinet of claim 14, wherein the metallic trim breaker defines a utility conduit that extends between a liner aperture in the metallic inner liner and a wrapper aperture in the metallic outer wrapper.

16. The structural cabinet of claim 14, wherein the cap member defines a contact surface for selectively receiving a magnetic seal of an operable door panel.

17. An appliance comprising:

a structural cabinet that includes a metallic inner liner and a metallic outer wrapper;

a metallic trim breaker that is welded to the metallic inner liner and the metallic outer wrapper to define an interior insulating cavity within the structural cabinet, wherein the metallic trim breaker includes undulating formations that define an effective length of the metallic trim breaker between the metallic inner liner and the metallic outer wrapper, the effective length being greater than a perpendicular distance separating the metallic inner liner from the metallic outer wrapper;

insulating spacers that are positioned between adjacent corrugations of the undulating formations of the metallic trim breaker, wherein the insulating spacers are positioned at ends of the adjacent corrugations to further define open spaces between each of the adjacent corrugations;

a cap member that extends between the metallic inner liner and the metallic outer wrapper, wherein the cap member conceals the undulating formations of the metallic trim breaker; and an inner cap that extends between the metallic inner liner and the metallic outer wrapper, the inner cap separating the undulating formations from an insulating material contained within the interior insulating cavity.

18. The appliance of claim 17, wherein the metallic trim breaker defines a utility conduit that extends between a liner aperture in the metallic inner liner and a wrapper aperture in the metallic outer wrapper.

19. The appliance of claim 17, wherein the cap member defines a contact surface for selectively receiving a magnetic seal of an operable door panel that engages the contact surface to define a closed position.

20. The appliance of claim 19, wherein the operable door panel includes a thermal dyke that engages an interior surface of the structural cabinet that defines an interior compartment when the operable door panel is in the closed position, and wherein the thermal dyke engages the structural cabinet at a position inward of the undulating formations, wherein the undulating formations proximate the metallic inner liner are substantially surrounded by an insulating air space defined between the thermal dyke and the interior surface of the interior compartment.

* * * * *